US005688159A

United States Patent [19]

Kusano et al.

[11] Patent Number: 5,688,159

[45] Date of Patent: Nov. 18, 1997

[54] METHOD OF AND APPARATUS FOR AUTOMATICALLY POLISHING A MOTHER BLANK OF SHEET COPPER

[75] Inventors: Mineharu Kusano; Kenzou Takabatake; Yutaka Kataoka, all of Okayama, Japan

[73] Assignee: Mitsui Mining & Smelting Co., Ltd., Tokyo, Japan

[21] Appl. No.: 358,823

[22] Filed: Dec. 19, 1994

[30] Foreign Application Priority Data

Feb. 21, 1994 [JP] Japan ..... 6-021744

[51] Int. Cl.[6] ..... B24B 49/00; B24B 51/00

[52] U.S. Cl. ..... 451/1; 451/5; 451/110

[58] Field of Search ..... 451/110, 194, 451/207, 241, 188, 182, 197, 1, 5

[56] References Cited

U.S. PATENT DOCUMENTS

| | | | |
|---|---|---|---|
| 3,768,208 | 10/1973 | Plichta et al. | 451/68 |
| 3,845,533 | 11/1974 | Tinfow et al. | 451/207 |
| 3,902,214 | 9/1975 | Schmitt | 15/93 |
| 4,034,433 | 7/1977 | Slingsby | 15/77 |
| 4,138,755 | 2/1979 | Hashimoto et al. | 451/194 |
| 4,148,108 | 4/1979 | Kamata et al. | 451/194 |
| 4,318,199 | 3/1982 | Kunz | 451/110 |
| 4,406,029 | 9/1983 | Kunz | 451/182 |
| 4,447,308 | 5/1984 | Willans | 204/279 |
| 4,691,684 | 9/1987 | Negron-Crespo | 451/188 |
| 4,782,545 | 11/1988 | Aiassa | 451/190 |

*Primary Examiner*—Timothy V. Eley
*Assistant Examiner*—Derris H. Banks
*Attorney, Agent, or Firm*—Flynn, Thiel, Boutell & Tanis, P.C.

[57] ABSTRACT

A device for automatically polishing a mother blank of sheet copper has a starting sheet auto-stripping line including a delivery device for carrying in mother blanks of sheet copper, a stripping device for stripping starting sheets from the mother blanks, a removal device for carrying out mother blanks after the starting sheets are stripped off and a device for polishing the surfaces of a mother blank from which starting sheets have been stripped off at a forward position in the direction in which the mother blanks are transferred.

3 Claims, 7 Drawing Sheets

METHOD OF AND APPARATUS FOR AUTOMATICALLY POLISHING A MOTHER BLANK OF SHEET COPPER

FIELD OF THE INVENTION

The present invention relates to a method for automatically and simultaneously polishing the surfaces of a mother blank of sheet copper and an apparatus using the method therein which is to be used in a starting sheet auto-stripping line.

BACKGROUND OF THE INVENTION

In the conventional type of polishing method as described above, an operator removes a defective mother blank from a starting sheet auto-stripping line manually, transfers the mother blanks to a bench, and polishes surfaces of the mother blanks, and all of the steps are performed manually. Also, in the polishing step, when one surface of a mother blank has been polished, the mother blank is hooked up with a hoist and turned upside down, and then another surface on the opposite side is similarly polished. Then, after a series of polishing steps are finished, the mother blank is again transported to and set in the starting sheet stripping line. As described above, in the conventional method, defective mother blanks are manually removed from the stripping line and polished one by one, so that the operation efficiency is remarkably low, and also it is not preferable from the view point of safety.

OBJECT AND SUMMARY OF THE INVENTION

It is an object of the present invention to provide, for solving the problems in the conventional technology, a method of, as well as an apparatus for, automatically and rapidly polishing the surfaces of a mother blank without taking off the mother blank from a starting sheet auto-striping line, and also for improving the operation efficiency and safety.

To achieve the objects as described above, a method of automatically polishing a mother blank of sheet copper according to the present invention comprises a step of contacting rotating brush rollers to the surfaces of a mother blank from which starting sheets have been stripped off when the mother blank stops at a specified position in a starting sheet auto-stripping line having a delivery device for carrying in mother blanks of sheet copper, a stripping device for stripping starting sheets from said mother blanks, and a removal device for carrying out the mother blanks after the starting sheets have been stripped off; and moving the rotating brush rollers up and down to simultaneously polish the surfaces of each mother blank. In one mode for carrying out the present invention, when a mother blank stops at the specified position of the rotating brush rollers provided as a pair respectively at upper and lower positions, each corresponding to a surface of the mother blank respectively, the lower pair of brush rollers access and contact the lower surfaces of the mother blank, while the upper pair access and contact the intermediate surfaces of the mother blank, then opposite surfaces of the mother blank are polished by both pairs of brush rollers, and when the lower pair of brush rollers reach the surfaces at an intermediate position of the mother blank and the upper pair to the opposite surfaces at a top of the mother blank respectively, both pairs of brush rollers go away from the surfaces of the mother blank, and thus polishing is finished.

To achieve the objects as described above, the automatic polishing apparatus for a mother blank of sheet copper according to the present invention has a polishing device for polishing the surfaces of the mother blank after the starting sheets have been stripped off, at a forward position in the direction in which the mother blanks are transferred, by rotating brush rollers in a starting sheet auto-stripping line comprising a delivery device for carrying in mother blanks of sheet copper, a stripping device for stripping off starting sheets from the mother blanks, and a removal device for carrying out the mother blanks after the starting sheets have been stripped off. In one mode of carrying out the present invention, the polishing device comprises two rotating brush rollers provided as a pair respectively at upper and lower positions each facing a surface of a mother blank respectively which can move closer to or away from the mother blank; actuating members for moving each of the brush rollers closer to or away from the mother blank; a first driving member for rotating and driving brush rollers; a second driving member for moving up and down the brush rollers; and a control member which controls the actuating member so that the lower pair of brush rollers goes closer to and contacts the surfaces at a lower position of the mother blank and the upper pair of brush roller goes closer to and contacts the surfaces at an intermediate position of the mother blank respectively when the mother blank stops at a specified position, and which controls the actuating member so that the lower pair of brush rollers goes closer to and contacts the surfaces at a lower position of the mother blank and the upper pair of brush rollers goes closer to and contacts the surfaces at an intermediate position of the mother blank, controls the second driving members so that, after contact, the brush rollers move upward, and also controls the actuating member so that the brush rollers go away from the surfaces of the mother blank when the lower pair of brush rollers reaches the surfaces at an intermediate position of the mother blank and the upper pair of brush rollers to the surfaces at an upper position of the mother blank respectively.

This automatic polishing apparatus has a centering device for positioning both side sections of a mother blank before polishing with the two pairs of brush rollers is started when the mother blank stops at a specified position, so that the mother blank can be precisely positioned by centering the mother blank, which is preferable because a polishing step can be carried out smoothly. Also, in the automatic polishing apparatus described above, it is desirable to provide a second driving member for each brush roller. Also, in the automatic polishing apparatus described above, it is desirable that the control member controls the first driving member so that the brush rollers start rotation before contacting both surfaces of a mother blank. Also, in the automatic polishing apparatus described above, it is desirable that the upper and lower brush rollers rotate in opposite directions respectively. Also, in the automatic polishing apparatus described above, it is desirable to provide a protection cover device for covering an insulating body section at an lower edge of a mother blank below a position of the mother blank when it stops at the specified position because it can effectively protect the insulating body section of the mother blank.

Furthermore, in one mode of carrying out the present invention, the control member controls the first driving member so that, as the brush rollers go upward, a rotational speed of the upper brush rollers becomes faster as compared to that of the lower brush rollers. Furthermore in one mode of carrying out the present invention, the control member controls the second driving member so that, as the brush rollers go upward, the speed of the upward movement of the brush rollers becomes slower.

As described above, when a mother blank from which the starting sheets have been stripped off in a starting sheet stripping line stops at a specified position, both surfaces of the mother blank are simultaneously polished by contacting rotating brush rollers to opposite surfaces of the mother blank and moving the rotating brush rollers up and down, so that the surfaces of the mother blank can automatically and rapidly be polished, and it is not required to manually remove defective mother blanks one by one from the stripping line as in conventional technology. For this reason, the workability and safety are extremely high.

Also, with the automatic polishing apparatus according to the present invention, the steps for removing a mother blank from a line and polishing it requiring around one hour for one sheet can be carried out in about 10 seconds and, for this reason, it is possible to largely reduce a working time and, also, such steps as manually removing mother blanks from a starting sheet stripping line, transferring the mother blanks to a bench for polishing, and setting the mother blanks in the stripping line are not required, so that the quantity of steps required for this job is substantially reduced. Also, though only defective mother blanks of sheet copper are polished in the conventional technology, all mother blanks can be polished with the automatic polishing apparatus according to the present invention, so that also the product quality is improved.

Also, the smoothness of the surfaces of a mother blank is not homogeneous, so opening can be executed well in a case where the surface is fine, but sometimes starting sheets may drop from a mother blank before the mother blank goes to a stripping device, which sometimes in turn results in damage to the stripping device or other components. On the other hand, if the surface of a mother blank is rough, the starting sheet does not drop, which makes opening impossible, so that sometimes the line goes down, thus the workability being deteriorated. With the automatic polishing apparatus according to the present invention, however, an upper section of a surface of a mother blank can be polished into a fine state and a lower section thereof into a relatively rough state, so that opening can be executed in good conditions, mother blanks from which the starting sheets do not drop can be obtained, breakage of devices and operation downtime of the line are eliminated, thus the operability and safety are remarkably improved.

BRIEF DESCRIPTION OF THE DRAWINGS

FIGS. 9A through 9F are explanatory views illustrating the operation of the polishing device.

DETAILED DESCRIPTION OF THE PREFERRED EMBODIMENTS

Figure 1:
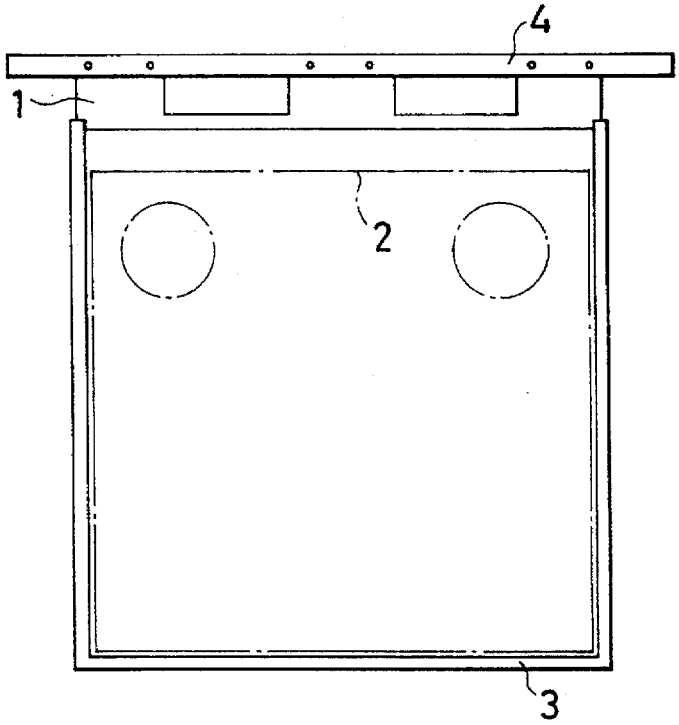
FIG. 1 is a front view illustrating a mother blank of sheet copper used in an embodiment of the present invention.

FIG. 1 shows a mother blank (cathode plate) used in an embodiment of the present invention, and on opposite surfaces of this mother blank 1 is electrolytically deposited a starting sheet (metal sheet) 2. The mother blank 1 is made from, for instance, a stainless steel plate or a rolled copper plate, and in the lower end section and in both side sections are provided insulating bodies 3. This mother blank 1 is transferred by being hooked and hoisted by a hook of a trolley conveyor via a cross bar 4 provided in the upper edge section thereof.

Figure 2:
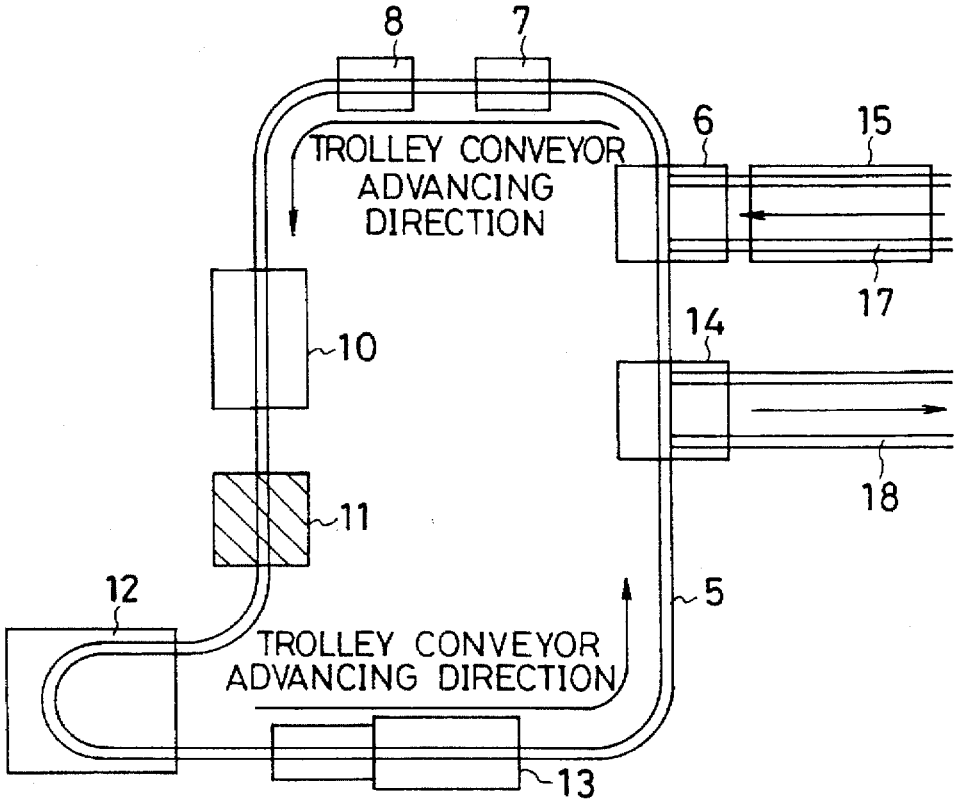
FIG. 2 is a general block diagram illustrating a line for automatically stripping a starting sheet electrolytically deposited on a mother blank.

FIG. 2 is a general block diagram illustrating a line for automatically stripping the starting sheet 2 electrolytically deposited on the surfaces of the mother blank 1. Thus, the auto-stripping line is provided with a trolley conveyor (not shown) for hoisting the mother blank 1 above a mother blank transfer path 5, both edges of which are connected to each other in endless fashion, and transferring the same. In the mother blank transfer path 5 are provided a delivery device 6 for carrying in the mother blank along the direction in which the trolley conveyor advances, a hammering device 7 and an opening device 8 for making the starting sheet 2 easily separable from the mother blank 1, a stripping device 10 for stripping the starting sheet 2 from the mother blank 1, a polishing device 11, a stripping solution coating device 13, and a mother blank removal device 14. At position 12, defective mother blanks are carried out off from the line, or new mother blanks are carried into the line. The reference numeral 15 indicates a cleaning device for cleaning off electrolytic solution deposited on the mother blank 1 before introduction into the delivery device 6.

In this line, several score sheets of mother blanks subjected to electrodeposition for one day in a starter cell are mounted by a crane onto a chain conveyor 17 in a front section of the cleaning device 15, where hot water is sprayed on the mother blanks to clean off the electrolytic solution. The cleaned mother blanks are transferred by the chain conveyor 17 to the delivery device 6, and mounted on the trolley conveyor one by one. The trolley conveyor is intermittently moved and driven so that it stops once after completion of the latter step (process) and then starts moving forward again. Then the mother blank 1 is set by the trolley conveyor in the hammering device 7, and the right and left upper sections of the starting sheet 2 are hammered as indicated by the circles in FIG. 1 so that the starting sheet 2, will easily be stripped from the mother blank 1. Then, the mother blank 1 is set by the trolley conveyor in the opening device 8, where the upper section of the starting sheet 2 made easily separable by the hammering, is sucked by a sucker, thus only the upper section thereof is separated from the mother blank 1. Then the mother blank 1 is set by the trolley conveyor into the stripping device 10, and a stripping arm, which is inserted into the upper section of the starting sheet 2 partially stripped as described above, comes down and the starting sheet 2 is stripped off. The two sheets of starting sheet stripped off from the opposite surfaces of the mother blank 1 are transferred together by a conveyor to a container.

The mother blank 1 from which the starting sheets have been stripped off is then transferred by the trolley conveyor into the polishing device 11, where the opposite surfaces thereof are polished, and this polishing process is described more in detail later. Of the polished mother blanks 1, defective mother blanks are carried to outside of the line by a device provided at position 12. Also new mother blanks are mounted from this position onto the trolley conveyor. Then, the mother blanks 1 are transferred by the trolley conveyor into the stripping solution coating device, where the stripping solution is coated on the mother blanks 1. Coating is executed by means of showering. Then the mother blanks 1 are transferred by the trolley conveyor into the removal device 14, where the mother blanks 1 are carried out one by one from the trolley conveyor and arrayed at a specified pitch on the chain conveyor 18. When the number of mother blanks arrayed on the chain conveyor 18 amounts to a certain number, the mother blanks are put in an electolytic cell by a crane. With this operation, a cycle of automatically stripping starting sheets from a mother blank of sheet copper is finished.

Figure 3:
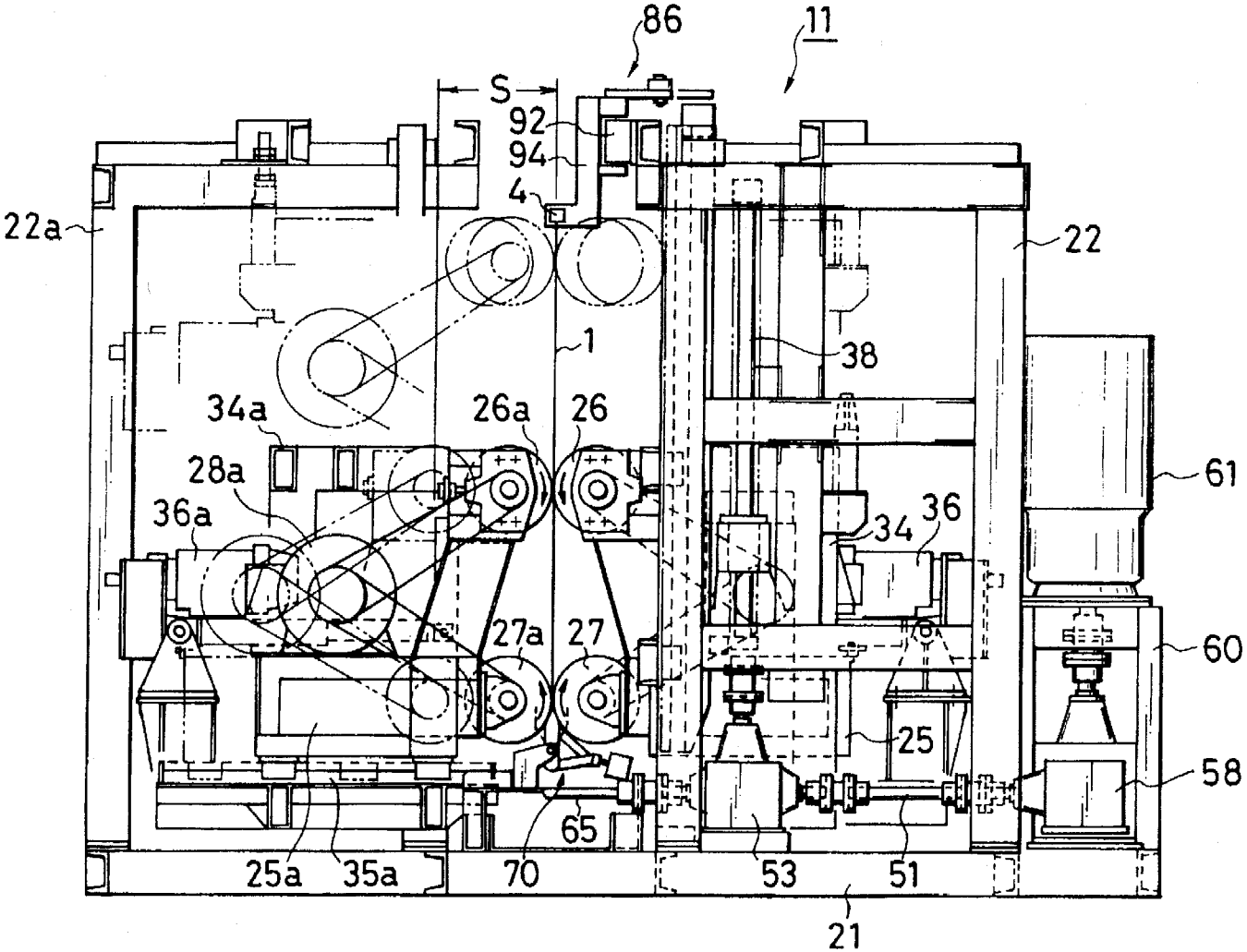
FIG. 3 is a partial front view illustrating a polishing device installed in a starting sheet auto-stripping line.

FIG. 3 is a partial front view illustrating the polishing device 11 installed in the starting sheet auto-stripping line described above.

Figure 4:
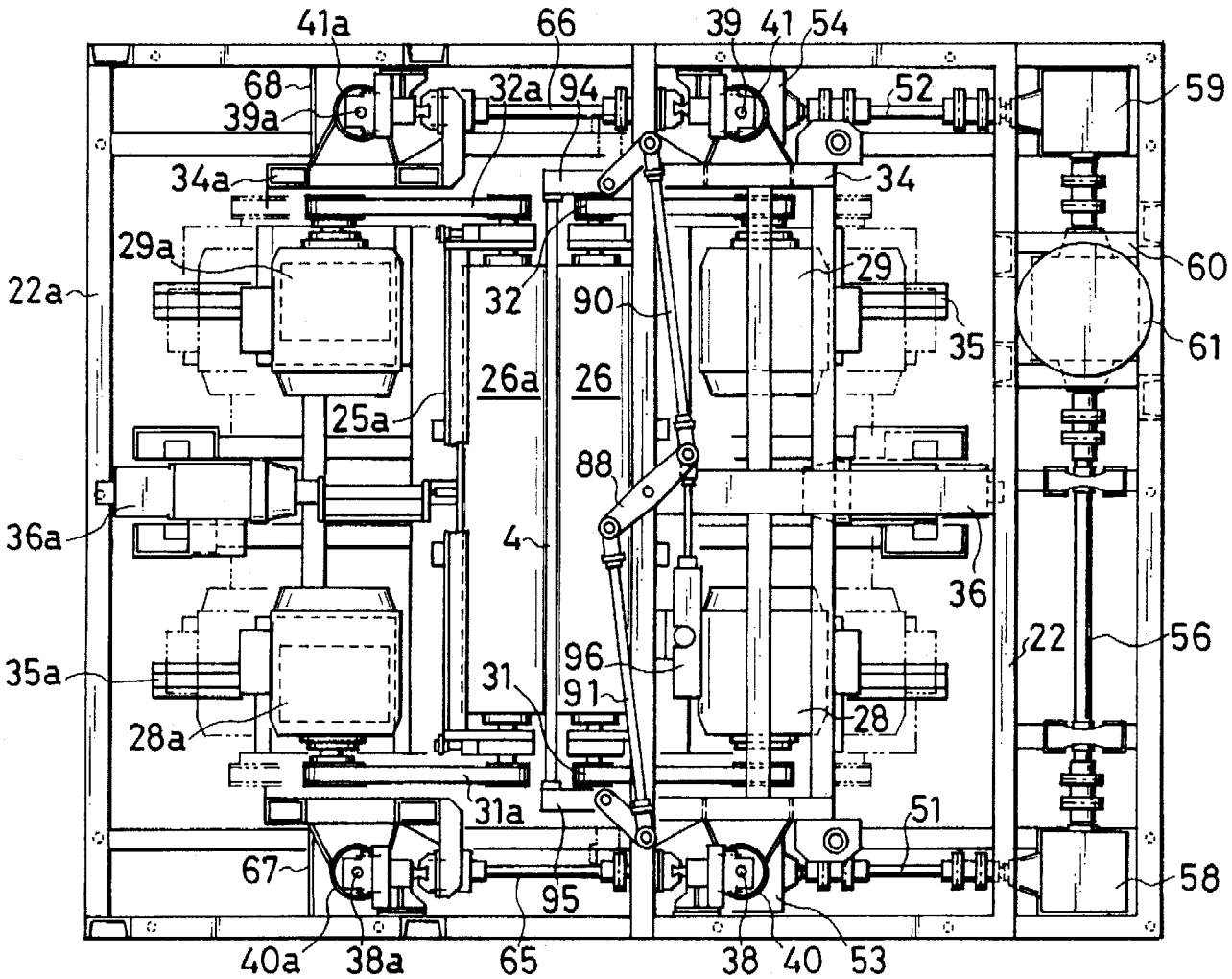
FIG. 4 is a partial top view illustrating a polishing device.
Figure 5:
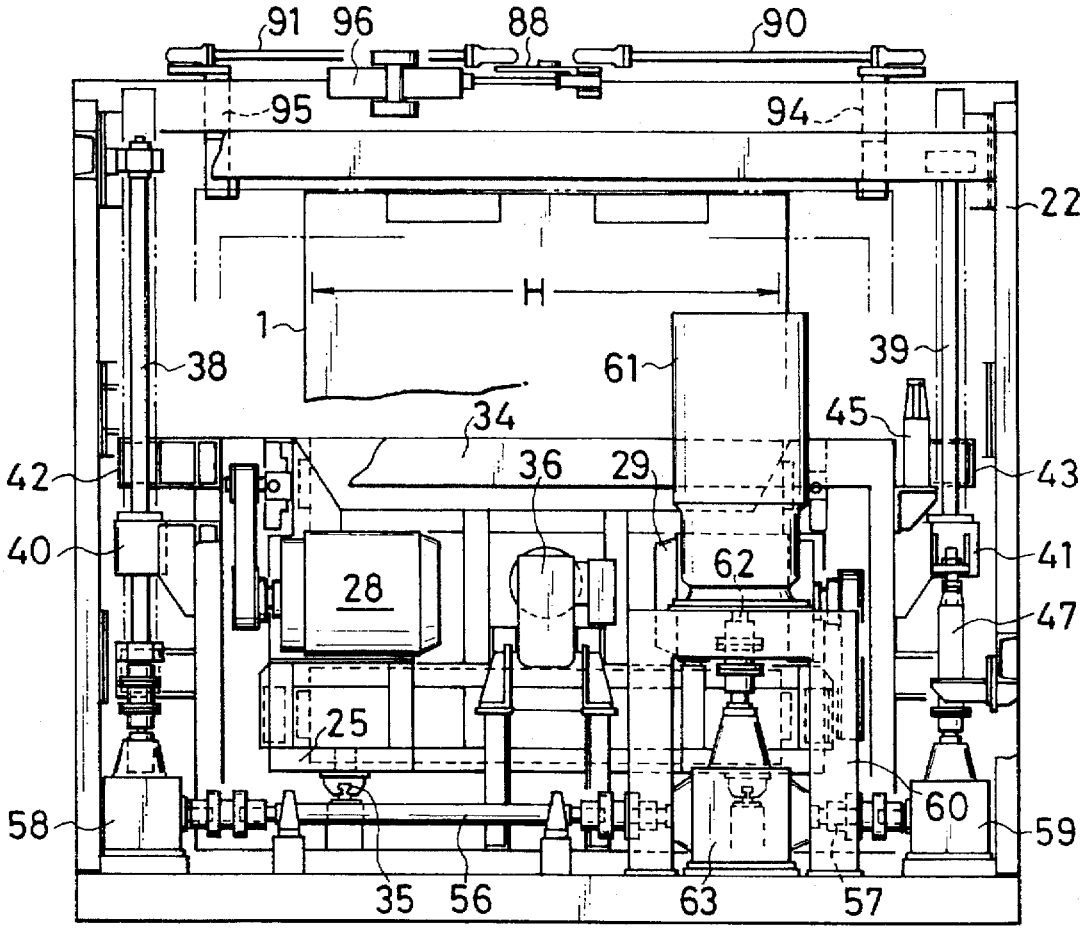
FIG. 5 is a partial side view illustrating a polishing device.

FIG. 4 is a partial top view thereof, and FIG. 5 is a partial side view illustrating the same. The polishing device 11 is provided with a pair of frames 22, 22*a* on a bed plate 21, and between the two frames 22, 22*a* is provided a gap to form a mother blank transfer path 5 for mother blank transferred by the trolley conveyor. On the two frames 22, 22*a* are provided brush roller frames 25, 25*a* respectively, and in the upper and lower sections of the opposite sides of the frames 25, 25*a* are rotatably provided brush rollers 26, 26*a*, 27, 27*a*. Each of the brush rollers is made of nylon with alumina impregnated therein. On the frames 25, 25*a* constituting a rear section of each of the brush rollers 26, 26*a*, 27, 27*a* are provided driving motors 28, 28*a*, 29, 29*a* as first driving members, and the driving motor 28, 28*a* rotate the upper brush rollers 26, 26*a* through driving belts 31, 31*a* respectively, while the driving motor 29, 29*a* rotate the lower brush rollers 27, 27*a* through driving belts 32, 32*a* respectively. The brush roller frames 25, 25*a* with the motors as described above provided thereon respectively are reciprocally movably provided in opposite directions along the guide rails 35, 35*a* in the bottom sections of the up/down frames 34, 34*a* provided on the frames 22, 22*a* respectively, and the reference numerals 36, 36*a* indicate a cylinder as an operating member for reciprocally moving the brush roller frames 25, 25*a* above.

In FIG. 3, the sign S indicates a stroke in reciprocal movement of the brush roller frames 25, 25*a*, and in the forward movement position, the brush rollers 26, 26*a*, 27, 27*a* contact the opposite surfaces of the mother blank 1 which comes to and stops at a specified position (for polishing). The up/down frames 34, 34*a* with the brush roller frames 25, 25*a* mounted thereon are vertically movably provided in the frames 22, 22*a*. The up/down frames 34, 34*a* have screw pieces 40, 40*a*, 41, 41*a* each screwed into vertically oriented ball-screw shafts 38, 38*a*, 39, 39*a* respectively, and are moved upward or downward by the screw pieces when the ball-screw shafts rotate. In FIG. 5, designated at the reference numerals 42, 43 is a slide guide, and at 45, 47 a shock damper.

Lower edge sections of the ball-screw shafts 38, 39 each have bevel gears provided in edge sections of rotation shafts 51, 52 and bevel gears screwed into the gear boxes 53, 54 respectively. Bevel gears provided at other edge sections of the rotation shafts 51, 52 are screwed into bevel gears provided respectively at edge sections of the rotation shafts 56, 57 arranged perpendicularly to each other outside of the frame 22 in gear boxes 58, 59. Bevel gears provided at other edge sections opposite to each of the rotation shafts 56, 57 are screwed in a gear box 63 to a motor shaft 62 of a driving motor 61 as a second driving member regularly and reversely rotatably provided upside down on a bracket 60 fixed to the frame 22. On the other hand, the bevel gears provided in lower edge sections of the ball-screw shafts 38*a*, 39*a* are screwed in bevel gears provided at edge sections of rotation shafts 65, 66 provided coaxially with the rotation shafts 51, 52 in gear boxes 67, 68. Bevel gears provided at other edge sections of the rotation shafts 65, 66 are screwed into bevel gears in the gear boxes 53, 54. With this construction, when the driving motor 61 is driven, the ball-screw shafts 38, 38*a*, 39, 39*a* are rotated via the motor shaft 62, rotation shafts 56, 57, rotation shafts 51, 52 and rotation shafts 65, 66, and the up/down frames 34, 34*a* are moved up and down along the screw shafts by the screw pieces 40, 40*a*, 41, 41*a* each screwed into the screw shafts.

Figure 6:
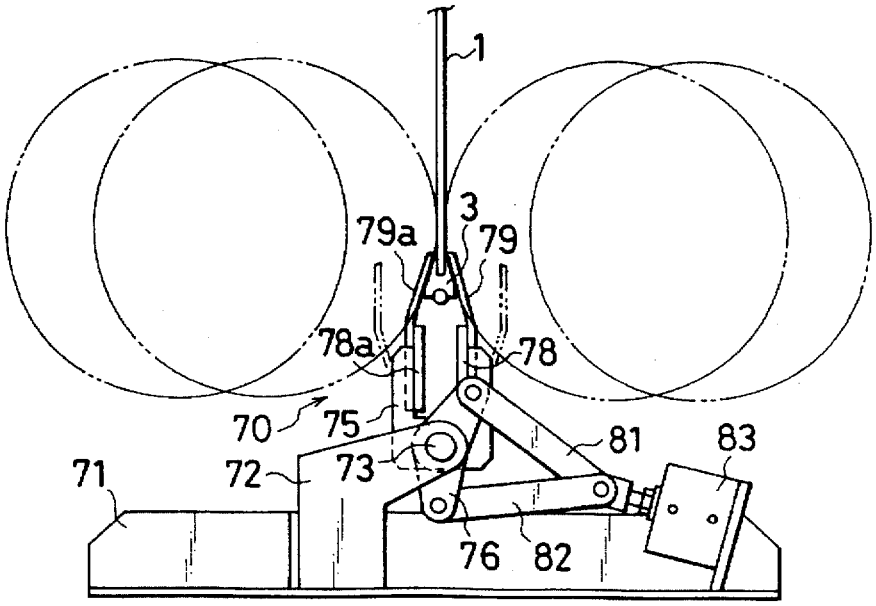
FIG. 6 is an enlarged front view illustrating a protection cover device.
Figure 7:
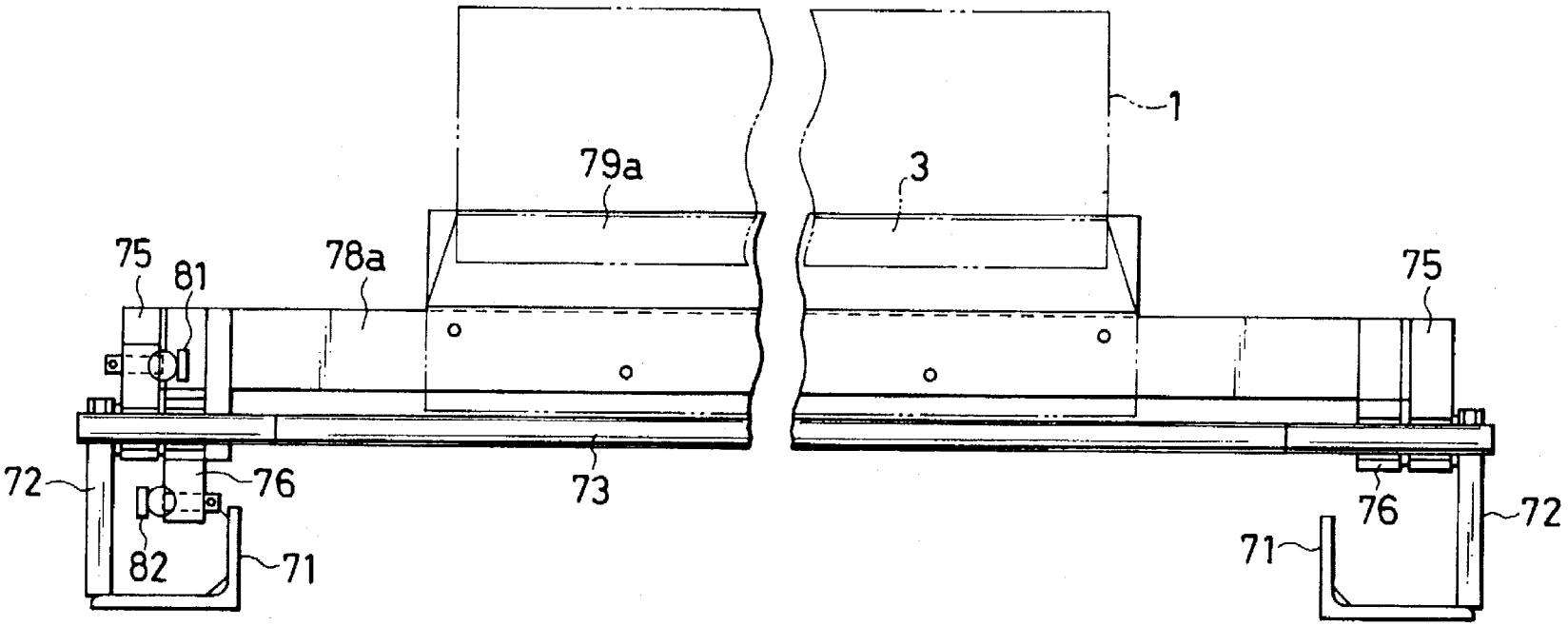
FIG. 7 is an enlarged side view illustrating a protection cover device.
Figure 8:
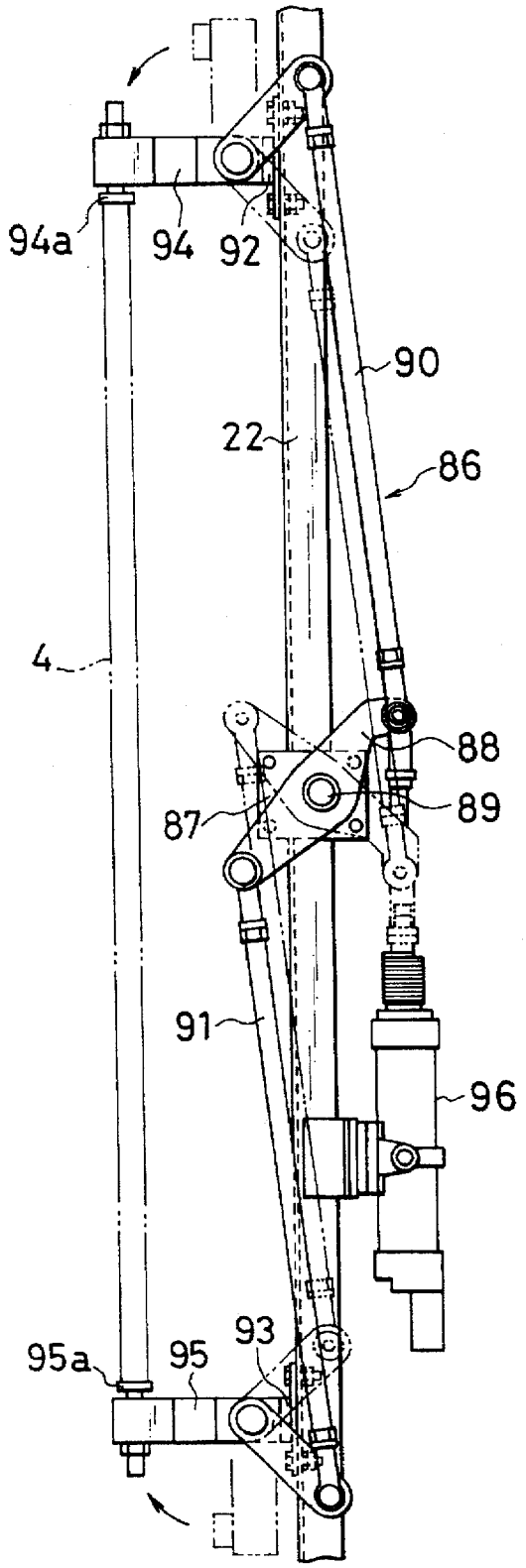
FIG. 8 is an enlarged top view illustrating a centering device.

As shown in FIG. 3, a protection cover device 70 which covers and protects the insulating body 3 provided at the lower edge section of the mother blank 1 is provided under the mother blank which has stopped for polishing. As more detailedly shown in FIG. 7 and FIG. 8, a pair of supporting frames 71 provided at front and rear sections of the bed plate 21 respectively, are provided with support pads 72 provided on the frame, and a support beam 73 spans between the support pads 72. At the front and rear edge sections of the support beam 73 are pivotably provided links 75, 76 respectively. Plates 78, 78*a* are attached between the front links and between the rear links respectively, and plate-like blades 79, 79*a* are attached to the plates 78, 78*a* respectively. Other edge sections of the links 75, 76 to which the plates 78, 78*a* are not attached, are attached to edge sections of rods 81, 82 respectively, and other edge sections of the rods are attached respectively to a rod tip section of the cylinder 83 provided on the frame 71. It should be noted that driving mechanisms for this cylinder 83 are respectively provided only by the links 75, 76 in one side as clearly shown at FIG. 7. For this reason, when the cylinder 83 is actuated, the plates 78, 78*a* of the links 75, 76 are pivoted by the rods 81, 82 in the direction where the plates 78 and 78*a* get closer to each other, and with this operation both the blades 79, 79*a* shift from an open state as indicated by a dashed line in FIG. 6 to a closed state as indicated by a solid line in the figure and covers the insulating body 3 on the mother blank 1 from both sides.

At a position above the mother blank 1, which has been stopped at the polishing position, is provided a centering device 86 for restricting the positions of the sides of the mother blank 1. Namely, as shown in details in FIG. 8, a link 88 is rotatably mounted via a supporting shaft 89 on a support pad 87 provided at a substantially central position of the frame 22, and edge sections of rod 90, 91 are pivotably supported on both edge sections of this link 88. Other edge sections of the rods 90, 91 are pivotably supported by links 94, 95, which are rotatably supported by bearings 92, 93 provided at the front and rear edge sections of the frame 22 at the side thereof closer to the frame 22*a*. It lower edge sections of the links 94, 95 are provided holding members 94*a*, 95*a* for holding both edge sections of the cross bar 4 provided at the upper edge section of the mother blank 1. To one edge section of the link 88 is attached a rod tip of the cylinder 96 provided on the frame 22, and when the cylinder 96 is actuated, the link 88, rods 90, 91, and links 94, 95 move from the state indicated by the dashed line in FIG. 8 to the state indicated by the solid line in the figure, so that both edge faces of the cross bar 4 are held by the holding sections 94*a*, 95*a* of the links 94, 95.

Figure 9A:
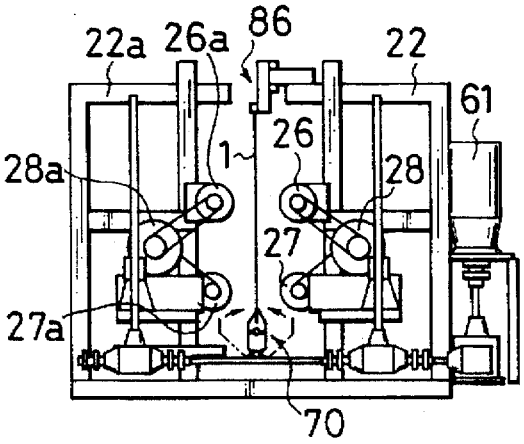

Next, description is made of the operation of the embodiment described above with reference to FIG. 9A through FIG. 9E. When the mother blank 1 with the upper edge section of the starting sheet 2 opened by the hammering device 7 and opening device 8 is transferred by the trolley conveyor to and reaches a position for polishing by the polishing device 11, the cylinder 96 of the centering device 86 is actuated to rotate the links 94, 95 with the two edge faces of the cross bar 4 of the mother blank 1 held by the holding sections 94*a*, 95*a*, thus, the side sections of the mother blank 1 are restricted for centering. Then the cylinder 83 of the protection cover device 70 is actuated, and the blades 79, 79*a* close and cover the insulating body 3 at the lower edge section of the mother blank 1 (Refer to FIG. 9A). With this operation, the upper edge section of the mother blank 1 is supported by the centering device 86, while the lower edge section thereof is firmly protected by the protection cover device 70. It should be noted that the operational sequence of the centering device 86 and protection cover device 70 may be either reversed or concurrent.

The motors 28, 29, 28*a*, 29*a* are driven simultaneously, and the brush rollers 26, 26*a*, 27, 27*a* are rotated in the opposite directions as indicated by the arrows in FIG. 3. Concurrently, the cylinders 36, 36*a* are actuated, when the brush roller frames 25, 25*a* move forward along the guide rails 35, 35*a* and the brush rollers 26, 26*a*, 27, 27*a* move closer to the opposite surfaces of the mother blank 1. Thus, polishing is started (Refer to FIG. 9B). Then the lower brush rollers 27, 27*a* contact the surface of the mother blank 1 at a lower section thereof, while the upper brush rollers 26, 26*a* contact the surfaces of the mother blank 1 at an intermediate section thereof.

After the brush rollers 26, 26*a*, 27, 27*a* contact the surfaces of the mother blank 1 respectively, the motor 61 is driven in the forward direction and with this operation, up/down frames 34, 34*a* are moved upward by the rotating ball-screw shafts 38, 39 along the screw shafts. With this upward movement, the brush rollers 26, 26*a*, 27, 27*a* are raised upward together with the motors 28, 29, 28*a*, 29*a* and cylinders 36, 36*a* and also together with the frames 34, 34*a*, and during this upward movement the brush rollers polish the surfaces of the mother blank 1 (FIG. 9C). In this embodiment, during this polishing operation the motors 28, 29, 28*a*, 29*a* as well as the motor 61 are controlled by an invertor so that the rotational speed and the vertical movement speed of the brush rollers 26, 26*a*, 27, 27*a* are optimized. Namely, as the brush rollers 26, 26*a*, 27, 27*a* move upward, the rotational speed of both the upper and lower brush rollers 26, 26*a*, 27, 27*a* increases, and also the relative rotational speed of the upper brush rollers 26, 26*a* becomes faster as compared to that of the lower brush rollers 27, 27*a* and, also, as the brush rollers 26, 26*a*, 27, 27*a* move upward, the speed of upward movement becomes slower. For this reason, the surfaces of the mother blank 1 in the lower section thereof are polished into rough surfaces, while the surfaces in the upper section are polished into fine and smooth surfaces.

Figure 9D:
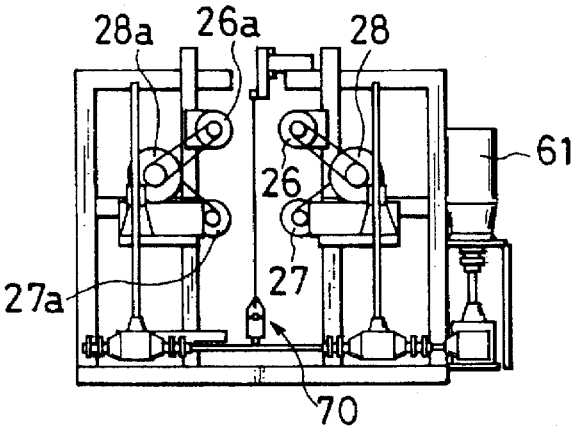
Figure 9B:
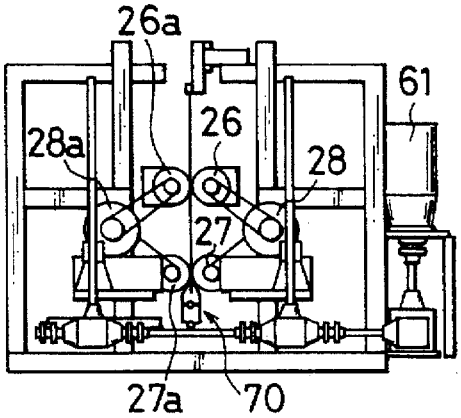
Figure 9E:
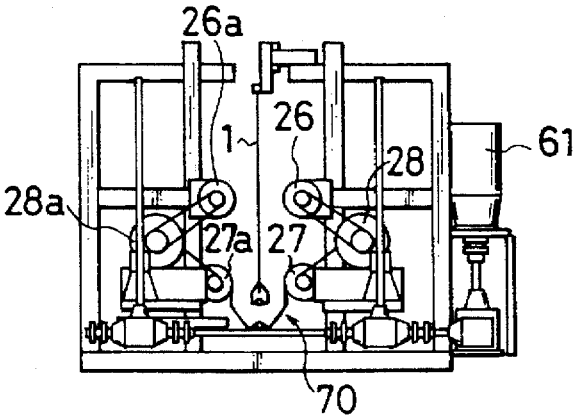
Figure 9C:
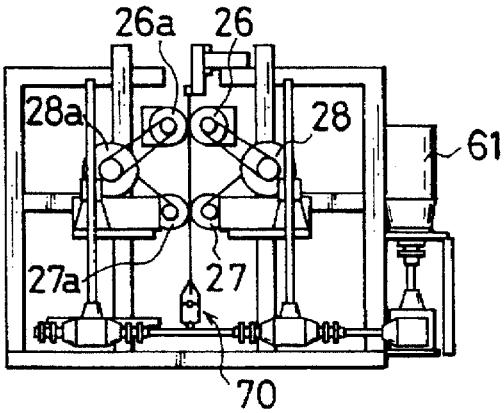

When the lower brush rollers 27, 27*a* and upper brush rollers 26, 26*a* reach the surfaces of the mother blank 1 at the intermediate section and at the upper section respectively, operation of the cylinders 36, 36*a* are released and, because of this, the brush roller frames 25, 25*a* go back along the guide rails 35, 35*a* and go away from the surfaces of the mother blank 1, the operation of the brush rollers 26, 26*a*, 27, 27*a* for polishing the surfaces of the mother blank are finished (Refer to FIG. 9D). As the brush roller frames 25, 25*a* go back, operation of the motors 28, 29, 28*a*, 29*a* is stopped, and rotation of the brush rollers 26, 26*a*, 27, 27*a* is stopped.

Also, the motor 61 is driven in the reverse direction, and the up/down frames 34, 34*a* are moved downward by the ball-screw shafts 38, 39 along the screw shafts with the brush rollers 26, 26*a*, 27, 27*a* being returned to their respective original positions. After this operation, operation of the cylinder 98 of the centering device 86 is released, so that centering of the mother blank 1 by the holding sections 94*a*, 95*a* is released and, at the same time, operation of the cylinder 83 of the protection cover device 70 is released. Thus the blades 79, 79*a* are opened with protection of the insulating body 3 of the mother blank 1 being released (Refer to FIG. 9E).

With the operation described above, the mother blank 1, with both centering by the centering device 86 and protection by the protection cover device 70 released, is transferred by the trolley conveyor to the position 12 in FIG. 2. With this operation, one cycle of the operation for polishing the surfaces of one sheet of mother blank 1 is finished. As described above, according to the present invention, it is possible to automatically and rapidly polish the surfaces of a mother blank with the polishing device 11 and the necessity for an operator to manually remove the mother blank 1 from a starting sheet auto-stripping line like in the conventional technology is eliminated.

In the operations described above, positioning of each operating member, such as the brush roller frames 25, 25*a*, is executed by means of detection by such a tool as a known access switch, not shown herein, and by a servo unit mechanism. Also, a control member is constructed with known members including these mechanisms to control each operating member as well as each driving member. Also, the rotational direction and rotational speed of the brush rollers 26, 26*a*, 27, 27*a* are only some of the preferred examples, and it is needless to say that the present invention is not limited to this embodiment.

Although a particular preferred embodiment of the invention has been disclosed in detail for illustrative purposes, it will be recognized that variation or modification of the disclosed apparatus, including the rearrangement of parts, lie within the scope of present invention.

What is claimed is:

1. A device for automatically polishing a mother blank of sheet copper having a layer of material deposited in sheet form on opposite surfaces thereof, said device comprising a delivery device for carrying in the mother blank of sheet copper; a stripping device for removing the deposited material from the surfaces of the mother blank; a polishing device for polishing the surfaces of the mother blank of sheet copper after the deposited material has been removed therefrom and a removal device for carrying out the polished mother blank; said polishing device comprising two pairs of rotary brush rollers, each pair of rotary brush rollers facing an opposite surface of said mother blank, an upper rotary brush roller in each pair being provided at an intermediate position of said mother blank and a lower rotary brush roller in each pair being provided at a lower position of said mother blank, an operating member for moving the rotary brush rollers to and from the surfaces of the mother blank, a first driving member for driving and rotating the rotary brush rollers, a second driving member for raising and lowering the rotary brush rollers and a control member for controlling the operating member so that said rotary brush rollers move into contact with the opposite surfaces of the mother blank when the mother blank stops at a specified location and move away from the opposite surfaces of said mother blank when the upper and lower rotary brush rollers reach an upper position and an intermediate position on the surface of the mother blank respectively, the second driving member so that the rotary brush rollers move upwardly after they initially come into contact with the surfaces of the mother blank and the first driving member so that the rotational speed of the upper brush rollers increases with respect to the lower brush rollers as the brush rollers move upward.

2. A device for automatically polishing a mother blank of sheet copper having a layer of material deposited in sheet form on opposite surfaces thereof, said device comprising a delivery device for carrying in the mother blank of sheet copper; a stripping device for removing the deposited material from the surfaces of the mother blank; a polishing device for polishing the surfaces of the mother blank of sheet copper after the deposited material has been removed therefrom and a removal device for carrying out the polished mother blank; said polishing device comprising two pairs of rotary brush rollers, each pair of rotary brush rollers facing an opposite surface of said mother blank, an upper rotary brush roller in each pair being provided at an intermediate position of said mother blank and a lower rotary brush roller in each pair being provided at a lower position of said mother blank, an operating member for moving the rotary brush rollers to and from the surfaces of the mother blank, a first driving member for driving and rotating the rotary brush rollers, a second driving member for raising and lowering the rotary brush rollers and a control member for controlling the operating member so that said rotary brush rollers move into contact with the opposite surfaces of the mother blank when the mother blank stops at a specified location and move away from the opposite surfaces of said mother blank when the upper and lower rotary brush rollers reach an upper position and an intermediate position on the surface of the mother blank respectively and the second driving member so that the rotary brush rollers move upwardly after they initially come into contact with the surfaces of the mother blank and the speed of upward movement of the rotary brush rollers decreases as the rotary brush rollers move up the surface of the mother blank.

3. A device for automatically polishing a mother blank of sheet copper having a layer of material deposited in sheet form on opposite surfaces thereof, said device comprising a delivery device for carrying in the mother blank of sheet copper; a stripping device for removing the deposited material from the surfaces of the mother blank; a polishing device for polishing the surfaces of the mother blank of sheet copper after the deposited material has been removed therefrom and a removal device for carrying out the polished mother blank; said polishing device comprising two pairs of rotary brush rollers, each pair of rotary brush rollers facing an opposite surface of said mother blank, an upper rotary brush roller in each pair being provided at an intermediate position of said mother blank and a lower rotary brush roller in each pair being provided at a lower position of said mother blank, an operating member for moving the rotary brush rollers to and from the surfaces of the mother blank, a first driving member for driving and rotating the rotary brush rollers, a second driving member for raising and lowering the rotary brush rollers and a control member for controlling the operating member so that said rotary brush rollers move into contact with the opposite surfaces of the mother blank when the mother blank stops at a specified location and move away from the opposite surfaces of said mother blank when the upper and lower rotary brush rollers reach an upper position and an intermediate position on the surface of the mother blank respectively, the second driving member so that the rotary brush rollers move upwardly after they initially come into contact with the surfaces of the mother blank and the speed of upward movement of the rotary brush rollers decreases as the rotary brush rollers move up the surface of the mother blank and the first driving member so that the rotational speed of the upper brush rollers increases with respect to the lower brush rollers as the brush rollers move upward.

* * * * *